US009182092B2

(12) United States Patent
Cercone

(10) Patent No.: US 9,182,092 B2
(45) Date of Patent: Nov. 10, 2015

(54) LIGHT FIXTURE WITH ADJUSTABLE DIRECTION LIGHTING

(71) Applicant: Samuel P. Cercone, Aliquippa, PA (US)

(72) Inventor: Samuel P. Cercone, Aliquippa, PA (US)

(73) Assignee: Brightline, Inc., Bridgeville, PA (US)

( * ) Notice: Subject to any disclaimer, the term of this patent is extended or adjusted under 35 U.S.C. 154(b) by 162 days.

(21) Appl. No.: 13/740,490

(22) Filed: Jan. 14, 2013

(65) Prior Publication Data

US 2013/0194791 A1 Aug. 1, 2013

Related U.S. Application Data

(60) Provisional application No. 61/586,423, filed on Jan. 13, 2012.

(51) Int. Cl.

| | |
|---|---|
| ***F21V 19/02*** | (2006.01) |
| ***F21S 8/04*** | (2006.01) |
| ***F21S 8/02*** | (2006.01) |
| ***F21V 21/14*** | (2006.01) |
| *F21V 21/30* | (2006.01) |
| *F21V 21/34* | (2006.01) |
| *F21Y 101/02* | (2006.01) |
| *F21Y 103/00* | (2006.01) |
| *F21Y 113/00* | (2006.01) |

(52) U.S. Cl.

CPC ..... *F21S 8/046* (2013.01); *F21S 8/026* (2013.01); *F21V 21/14* (2013.01); *F21V 21/34* (2013.01); *F21Y 2101/02* (2013.01); *F21Y 2103/00* (2013.01); *F21Y 2113/00* (2013.01)

(58) Field of Classification Search

CPC ..... F21V 14/00; F21V 14/02; F21V 14/025; F21Y 2103/00–2103/006; F21Y 2105/00–2105/005

USPC ..... 362/187–188, 220, 225, 232–234, 362/238–240

See application file for complete search history.

(56) References Cited

U.S. PATENT DOCUMENTS

| | | | | |
|---|---|---|---|---|
| 5,921,666 | A * | 7/1999 | Preston et al. | 362/341 |
| 6,517,216 | B1 | 2/2003 | Cercone et al. | |
| 6,893,139 | B2 | 5/2005 | Cercone et al. | |
| 8,303,135 | B2 | 11/2012 | Cercone | |
| 2010/0315810 | A1 * | 12/2010 | Tseng | 362/234 |

* cited by examiner

*Primary Examiner* — Anh Mai
*Assistant Examiner* — Nathaniel Lee
(74) *Attorney, Agent, or Firm* — The Webb Law Firm

(57) ABSTRACT

A lighting fixture includes first and second elongated lamp carriage assembles supporting respective first and second elongated lamps and an enclosure including first and second spaced plates. The first lamp carriage assembly is fixedly coupled between the first and second plates for directing light output by the first lamp in a first direction. The second lamp carriage assembly is slidably and pivotally coupled at its ends to the first and second plates for directing light output by the second lamp in a second direction that crosses the first direction. The lighting fixture can further include a third elongated lamp carriage assembly supporting a third elongated lamp. The third lamp carriage assembly is slidably and pivotally coupled at its ends to the first and second plates for directing light output by the third lamp in a third direction that crosses the first and second directions.

19 Claims, 7 Drawing Sheets

LIGHT FIXTURE WITH ADJUSTABLE DIRECTION LIGHTING

CROSS REFERENCE TO RELATED APPLICATION

This application claims priority from U.S. Provisional Patent Application No. 61/586,423, filed Jan. 13, 2012, which is incorporated herein by reference.

BACKGROUND OF THE INVENTION

1. Field of the Invention

The present invention relates to lighting fixtures for plaster/drywall ceiling and drop ceilings, and, more particularly, to lighting fixtures that include fixed direction lighting and directionally adjustable lighting.

2. Description of Related Art

Dropped ceilings are well known in the art as secondary ceilings that are hung below a main (structural) ceiling. Dropped ceilings are also referred to as a drop ceiling, false ceiling, or suspended ceiling, and are utilized widely in modem construction and architecture.

It is well known in the art for dropped ceilings to include one or more lighting fixtures that are supported by the gridwork of the dropped ceiling in a plenum space defined in the area above the dropped ceiling.

Plaster or drywall ceilings are also known in the art to include one or more lighting fixtures supported in one or more spaces above the ceilings, typically between joists that define the support structure of the plaster or drywall ceiling.

Heretofore, such lighting fixtures were configured to direct light in a single direction into a room below the ceiling. It is, however, desirable in certain applications to be able to direct light from a lighting fixture into two or more directions into a room below the ceiling. Such applications include, without limitation, architecturally ecstatic lighting, video conferencing, distance learning, telemedicine, internet video streaming, and non traditional studio environments.

SUMMARY OF THE INVENTION

Disclosed is a lighting fixture comprising: an elongated housing defining an elongated opening. An interior of the housing defines a first space aligned with the elongated opening and a second space to a first side of the first space and not aligned with the opening. First and second lamp carriage assemblies are positioned in the respective first and second spaces inside the housing with their longitudinal axes substantially parallel with the elongated opening. The first lamp carriage assembly is positioned for directing light output by a lamp of the first lamp carriage assembly through the elongated opening in a first direction. The second lamp carriage assembly is positioned for directing light output by a lamp of the second lamp carriage through the elongated opening in a second direction.

Rays of light output by the lamp of the first lamp carriage assembly that pass directly from the lamp through the opening in the first direction pass substantially normal to the opening. Rays of light output by the lamp of the second lamp carriage assembly that pass directly from the lamp through the opening in the second direction pass transverse to the opening.

The longitudinal axes of the first and second lamp carriage assemblies can be positioned at different vertical distances from the opening.

The lighting fixture can include means for adjusting an orientation of the second lamp carriage assembly and, hence, an angle of the second direction that the second lamp carriage directs rays of light output by the lamp thereof.

The means for adjusting can include at or adjacent each end of the housing: a pair of spaced slots in a plate, and a bracket slidably and pivotally coupling one end the second lamp carriage assembly to the pair of spaced slots. The pair of spaced slots and bracket are adapted to enable the second lamp carriage assembly to slidably and pivotally move in the second space between a location away from the first space and a location toward the first space.

Each slot can slidably receive an elongated member that is fixed at one end to the bracket. Each elongated member can be a bolt having a head on one side of the slot and male threads on the other side of the slot, which male threads are mated with female threads of a fastener on the other side of the slot.

The first lamp carriage assembly can include a first reflector for reflecting the light output by the lamp of the first lamp carriage assembly in the first direction. The second lamp carriage assembly can include a second reflector for reflecting the light output by the lamp of the second lamp carriage assembly in the second direction.

Each lamp carriage assembly can include a lamp. Each lamp can comprise a fluorescent lamp, or one or more light emitting diodes (LEDs).

The lighting fixture can include a fluorescent lamp ballast operative for controlling electrical power to the lamp, in the nature of a fluorescent lamp, of at least one lamp carriage assembly. Also or alternatively, the lighting fixture can include an LED driver (or ballast) operative for controlling electrical power to the lamp, in the nature of one or more LEDs, of at least one lamp carriage assembly.

The interior of the housing can include a third space to a second side of the first space opposite the second space. A third lamp carriage assembly can be positioned in the third space inside the housing with its longitudinal axis substantially parallel with the elongated opening. The third lamp carriage assembly can be positioned for directing light output by a lamp of the third lamp carriage through the elongated opening in a third direction.

Rays of light output by the lamp of the first lamp carriage assembly that pass directly from the lamp through the opening in the first direction pass substantially normal to the opening. Rays of light output by the lamp of the second lamp carriage assembly that pass directly from the lamp through the opening in the second direction pass transverse to the opening. Rays of light output by the lamp of the third lamp carriage assembly that pass directly from the lamp through the opening in the third direction also pass transverse to the opening.

The longitudinal axes of the first and second lamp carriage assemblies can be positioned at different vertical distances from the opening. The longitudinal axes of the first and third lamp carriage assemblies can be positioned at different vertical distances from the opening. The longitudinal axes of the second and third lamp carriage assemblies can be positioned at the same vertical distance from the opening.

The lighting fixture can include means for adjusting an orientation of the second lamp carriage assembly and, hence, an angle of the second direction that the second lamp carriage directs rays of light output by the lamp thereof. The lighting fixture can also include means for adjusting an orientation of the third lamp carriage assembly and, hence, an angle of the third direction that the third lamp carriage directs rays of light output by the lamp thereof.

Also disclosed is a lighting fixture comprising: first and second elongated lamp carriage assembles supporting respective first and second elongated lamps; and an enclosure including first and second spaced plates. The first lamp carriage assembly is fixedly coupled between the first and second plates for directing light output by the first lamp in a first direction. The second lamp carriage assembly is slidably and pivotally coupled at its ends to the first and second plates for directing light output by the second lamp in a second direction that crosses the first direction.

The first lamp carriage assembly can be coupled to a top of the enclosure.

Each plate can include a pair of spaced slots and each end of the second lamp carriage assembly can include a pair of spaced elongated members that extend through the pair of spaced slots in the plate to which said end is slidably and pivotally coupled, wherein responsive to slidable movement of the elongated members in the slots the second lamp carriage assembly slides and pivots.

The pair of spaced slots in each plate are configured such that the second lamp carriage assembly pivots during sliding of the second lamp carriage assembly toward and away from the first lamp carriage assembly. When the second lamp carriage assembly slides toward the first lamp carriage assembly the second lamp carriage assembly pivots such that where the second direction of the light output by the second lamp crosses the first direction of the light output by the first lamp moves away from the first lamp carriage assembly. When the second lamp carriage assembly slides away the first lamp carriage assembly the second lamp carriage assembly pivots such that where the second direction of the light output by the second lamp crosses the first direction of the light output by the first lamp moves toward the first lamp carriage assembly.

The first direction can be substantially normal to an opening in a housing of the lighting fixture. The second direction can be transverse to the opening in the housing.

The lighting fixture can further include a third elongated lamp carriage assembly supporting a third elongated lamp. The third lamp carriage assembly is slidably and pivotally coupled at its ends to the first and second plates for directing light output by the third lamp in a third direction that crosses the first and second directions.

Each lamp carriage assembly can include a lamp.

DESCRIPTION OF THE PREFERRED EMBODIMENTS

Figure 1:
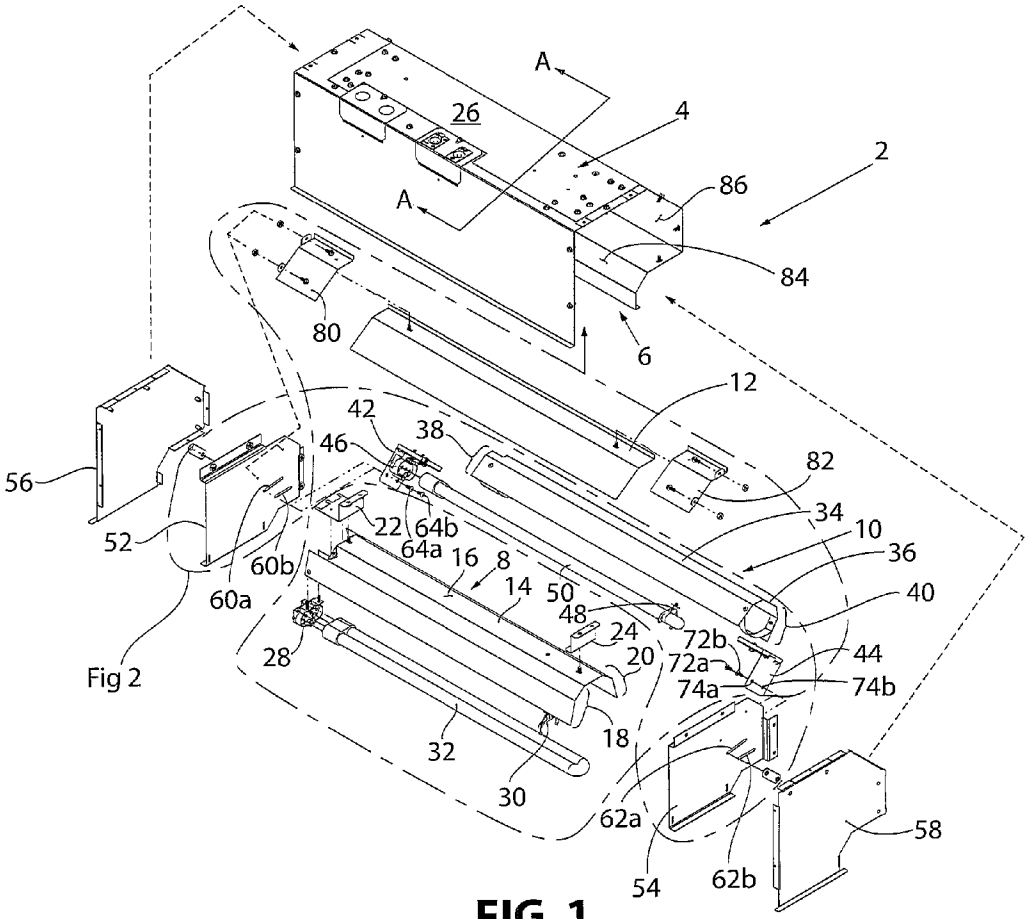
FIG. 1 is an exploded perspective view of a first embodiment lighting fixture including a fixed direction lamp carriage assembly and a movable lamp carriage assembly whereupon light output from the lighting fixture can be directed into two different directions.

With reference to FIG. 1, a first embodiment lighting fixture 2 includes an elongated housing 4 that is adapted to receive in an interior 6 thereof a first, stationary lamp carriage assembly 8, a second, slidable and pivotable lamp carriage assemble 10, and a reflector plate 12.

First lamp carriage assembly 8 includes a reflector 14 that has a top 16 and sides 18 and 20 on opposite sides of top 16. A pair of brackets 22 and 24 is attached to opposite ends of top 16. Brackets 22 and 24 are adapted to fixedly couple first lamp carriage assembly 8 to a top 26 of housing 4. First lamp carriage assembly 8 also includes at least one lamp holder 28 attached at one end of reflector 14 and at least one lamp support 30 affixed to top 16 opposite lamp holder 28.

In use of first lamp carriage assembly 8, lamp holder 28 is mated with a mating electrical connector of a lamp 32 that enables electrical power to be supplied to lamp 32 via lamp holder 28 in a manner known in the art. While lamp 32 in FIG. 1 is shown in the form of a fluorescent lamp, it is envisioned that lamp 32 in the form of the fluorescent lamp can be replaced with one or more LEDs that perform the same function. The end of lamp 32 opposite lamp holder 28 can be held in place by lamp support 30 whereupon lamp 32 is held in fixed relation within first lamp carriage assembly 8.

Second lamp carriage assembly 10 includes a reflector 34 that has a top 36 and sides 38 and 40 on opposite sides of top 36. L-shaped brackets 42 and 44 are coupled to top 36 at opposite ends of reflector 34 and define the ends of second lamp carriage assembly 10. Lamp carriage assembly 10 also includes a lamp holder 46 coupled to bracket 42 and a lamp support 48 coupled to top 36 of reflector 34.

In use of second lamp carriage assembly 10, lamp holder 46 is mated with a mating electrical connector of a lamp 50 that enables electrical power to be supplied to lamp 50 via lamp holder 46 in a manner known in the art. While FIG. 1 shows lamp 50 in the form of a fluorescent lamp, it is envisioned that lamp 50 in the form of a fluorescent lamp can be replaced with one or more LEDs that perform the same function. The end of lamp 50 opposite lamp holder 46 can be held in place by lamp support 48 whereupon lamp 50 is held in fixed relation within second lamp carriage assembly 10.

The portions of brackets 42 and 44 defining the ends of second lamp carriage assembly 10 are slidably and pivotably coupled to first and second spaced plates 52 and 54 in a manner to be described hereinafter. The combination of plates 52 and 54 slidably and pivotably supporting second lamp carriage assembly 10 can be mounted in interior 6 of housing 4 along with first lamp carriage assembly 8 at locations within interior 6 described in greater detail in connection with FIGS. 3A-3C.

Once plates 52, 54 and first and second lamp carriage assemblies 8 and 10 are mounted in interior 6 of housing 4, optional cosmetic end plates 56 and 58 can be mounted to the ends of housing 4.

Figure 2:
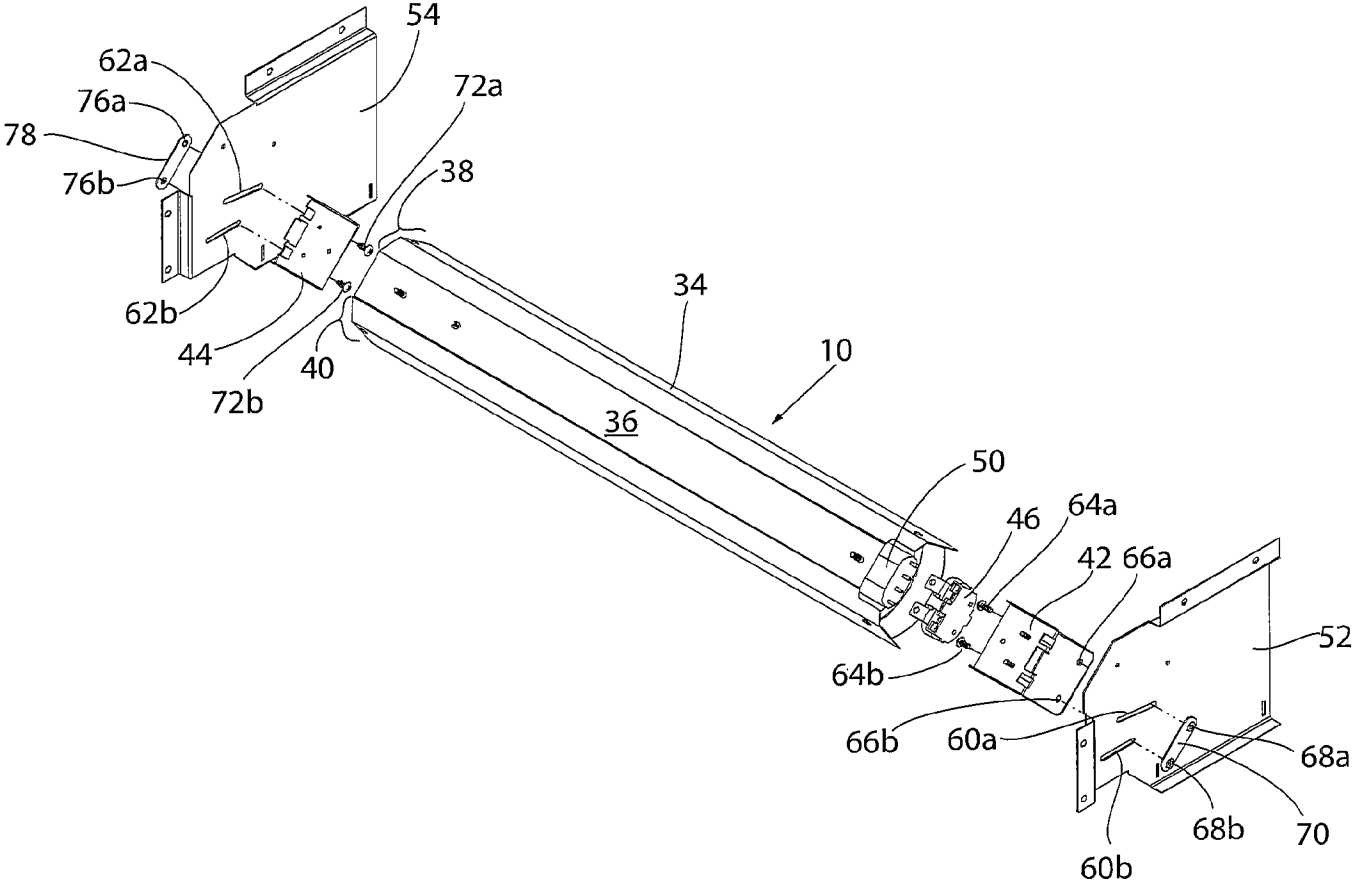
FIG. 2 is an isolated perspective view of the movable lamp carriage assembly of FIG. 1.

With reference to FIG. 2 and with continuing reference to FIG. 1, first plate 52 includes a pair of spaced slots 60*a* and 60*b* while second plate 54, which is a mirror image of first plate 52, includes a pair of spaced slots 62*a* and 62*b* in mirror image relation to slots 60*a* and 60*b*, respectively. A pair of bolts 64*a* and 64*b* is inserted into slots 60*a* and 60*b*, respectively, of first plate 52 via holes 66*a* and 66*b* in the depending portion of bracket 42 that forms the end of second lamp carriage assembly 10. The threaded ends of bolts 64*a* and 64*b* are mated with female threads of fasteners 68*a* and 68*b* of an oval shaped bracket 70. In a similar manner, bolts 72*a* and 72*b* are inserted into slots 62*a* and 62*b*, respectively, of second plate 54 via holes 74*a* and 74*b* (FIG. 1) in the depending portion of bracket 44 defining the other end of lamp carriage assembly 10. The threaded ends of bolts 72*a* and 72*b* are mated with female threads of fasteners 76*a* and 76*b* of an oval shaped bracket 78. Brackets 42 and 44 coupled between top 16 of reflector 14 and first and second plates 52 and 54 via slots 60*a*, 60*b*, 62*a*, and 62*b*, bolts 64*a*, 64*b*,72*a*, and 72*b*, and brackets 70 and 78 facilitate the slidable and pivotable movement of second lamp carriage assembly 10 within interior 6 of housing 4.

Figure 3A:
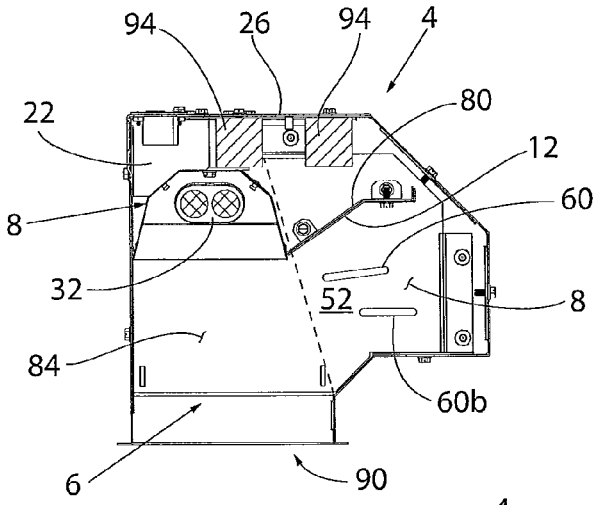
FIG. 3A is a section taken along lines A-A in FIG. 1 with the fixed lighting fixture installed but absent the movable lighting fixture.

FIG. 3A is a cross section taken along lines A-A in FIG. 1 after first lamp carriage assembly 8 and reflector plate 12 have been installed in interior 6, but before second lamp carriage assembly 10 has been installed in interior 6. As shown in FIG. 3A, first lamp carriage assembly 8 is fixedly coupled to top 26 of housing 4 via bracket 22, and reflector plate 12 is fixedly mounted to first plate 52 via an interface bracket 80 (FIG. 1). The other end of reflector plate 12 not shown in FIG. 3A, but shown in FIG. 1, is fixedly coupled to second plate 54 via an interface bracket 82 (FIG. 1).

Figure 3B:
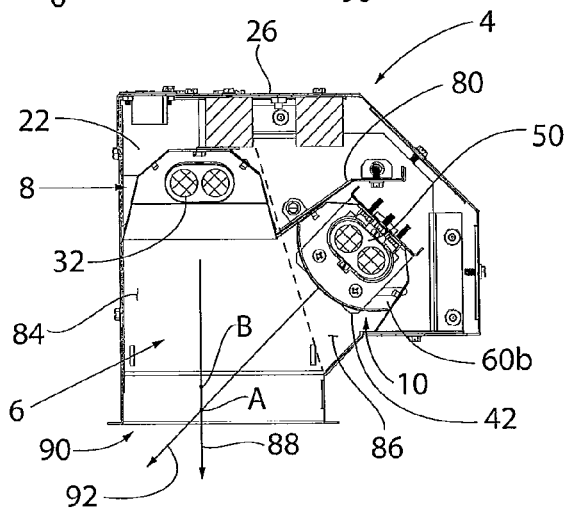
FIG. 3B is a section taken along lines A-A in FIG. 1 including the fixed and movable lighting fixtures, with the movable lighting fixture positioned at one extreme of its movement.
Figure 3C:
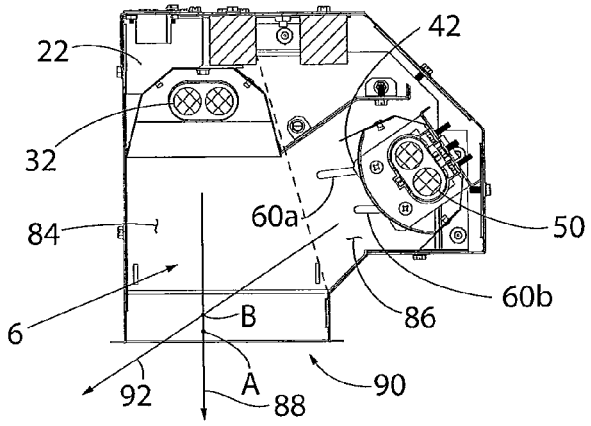
FIG. 3C is the section of FIG. 3B including the movable lighting fixture at the other extreme of its movement.

First lamp carriage assembly 8 is positioned in a first space 84 defined within housing 4 which also defines a second space 86 where second lamp carriage assembly 10 is positioned when installed in interior 6 as shown in FIGS. 3B and 3C.

As can be seen and understood from FIGS. 2, 3B and 3C, slots 60*a* and 60*b* and bracket 42, along with slots 62*a* and 62*b* and bracket 44 are adapted to enable second lamp carriage assembly 10 to slidably and pivotably move in second space 86 between a location adjacent first space 84 (FIG. 3B) and a location away from first space 84 (FIG. 3C), or to any location therebetween.

As shown in FIGS. 3B and 3C, the longitudinal axes of first and second lamp carriage assemblies 8 and 10 are positioned at different vertical distances from an opening 90 of housing 4. More specifically, first lamp carriage assembly is mounted at a higher vertical distance from opening 90 than second lamp carriage assembly 10. This arrangement allows slidable and pivotable movement of second lamp carriage assembly 10 within housing 4 while avoiding second lamp carriage assembly 10 from blocking light output by a lamp of first lamp carriage assembly 8.

As shown in FIGS. 3B and 3C, in response to illumination of lamp 32 coupled to first lamp carriage assembly 8, rays of light output by lamp 32 are directed generally in the direction shown by arrow 88, which is normal to opening 90 of housing 4. In contrast, in response to illumination of lamp 50 coupled to second lamp carriage assembly 10, rays of light output by lamp 50 are directed generally in the direction shown by arrow 92 that crosses the direction of rays of light output by lamp 32 illustrated by arrow 88.

As shown in FIG. 3B, when second lamp carriage assembly 10 is slid toward first lamp carriage assembly 8, i.e., toward first space 84, second lamp carriage assembly 10 pivots such that where the rays of light output by lamp 50 (shown by arrow 92) cross the rays of light output by lamp 32 (shown by arrow 88) moves away from the first lamp carriage assembly 8, e.g., from point B toward point A in FIG. 3B. In contrast, as shown in FIG. 3C, when second lamp carriage assembly 10 slides away from first lamp carriage assembly 8, and, hence, away from first space 84, second lamp carriage assembly 10 pivots such that where the rays of light output by lamp 50 (shown by arrow 92) cross the rays of light output by lamp 32 (shown by arrow 88) moves toward first lamp carriage assembly 8, e.g., from point A toward point B in FIG. 3C. In other words, by sliding second lamp carriage assembly 10 between the extreme positions shown in FIGS. 3B and 3C, the general direction of the rays of light output by lamp 50 can be redirected, e.g., between 5 and 15 degrees, depending upon the configuration of slots 60*a*, 60*b*, 62*a* and 62*b*.

Figure 4:
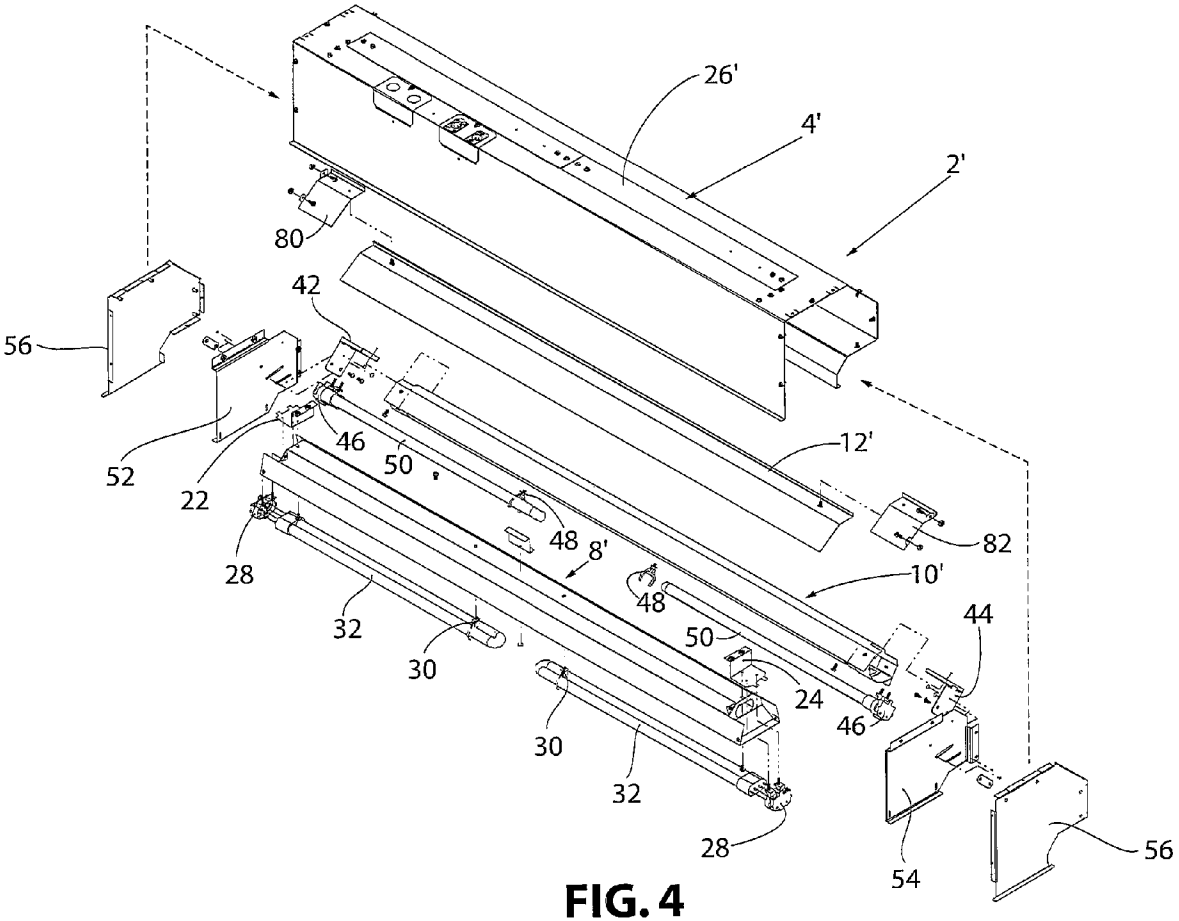
FIG. 4 is an exploded perspective view of a second embodiment lighting fixture which is an elongated version of the first embodiment lighting fixture of FIG. 1 which is adapted so that each lamp carriage assembly supports a plurality of lamps.

With reference to FIG. 4 and with continuing reference to FIGS. 1-3C, another embodiment lighting fixture 2' is similar to the embodiment lighting fixture 2 shown in FIG. 1 except that the lengths of housing 4', first lamp carriage assembly 8', second lamp carriage assembly 10', and reflector plate 12' in lighting fixture 2' are longer than the lengths of housing 4, first lamp carriage assembly 8, second lamp carriage assembly 10, and reflector plate 12 of lighting fixture 2 in FIG. 1. Because of its additional length, first lamp carriage assembly 8' mounted to top 26' of housing 4', can support a plurality, e.g., two, lamp holders 28 at opposite ends thereof, two lamp supports 30 and two lamps 32. Each lamp 32 can be electrically and physically supported by a lamp holder 28 and a lamp support 30 of first lamp carriage assembly 8' in a manner known in the art. The two lamps 32 of first lamp carriage assembly 8' can extend towards each other with their distal ends in spaced relation. However, this is not to be construed as limiting the invention.

Similarly, because of its additional length, second lamp carriage assembly 10' is able to support a plurality, e.g., two, lamp holders 46 on opposite ends thereof, two lamp supports 48 and two lamps 50. Each lamp 50 can be electrically and physically supported by a lamp holder 46 and lamp support 48 in a manner known in the art. The two lamps 50 of second lamp carriage assembly 10' can extend towards each other with their distal ends in spaced relation. However, this is not to be construed as limiting the invention.

While the embodiment of lighting fixture 2' shown in FIG. 4 illustrates first lamp carriage assembly 8' supporting a pair of lamps 32 and second lamp carriage assembly 10' supporting a pair of lamps 50, this is not to be construed as limiting the invention since it is envisioned that the length of each lamp carriage assembly 8' and 10' can be adapted to support any number of lamp holders, lamp supports and lamps deemed suitable and/or desirable. In addition, while FIG. 4 shows lamps 32 and 50 in the form of fluorescent lamps, this is not to be construed as limiting the invention since it is envisioned that each lamp in the form of a fluorescent lamp can be replaced with one or more LEDs that perform the same function.

Where the embodiments of lighting fixture 2 and 2' shown in FIGS. 1 and 4 include fluorescent lamps, each said lighting fixture can include any suitable number of fluorescent lamp ballast 94 (see FIGS. 3A-3C), desirably coupled to the top of the corresponding housing. Each ballast 94 can be coupled to one or more lamp holders by suitable electrical wiring that facilitates the supply of the electrical power from said ballast 94 to each lamp that is plugged into said lamp holder(s). Where the embodiments of lighting fixture 2 and 2' shown in FIGS. 1 and 4 include lamps, each of which is comprised of one or more LEDs, each said lighting fixture can include an LED driver (or ballast) in replacement of each fluorescent lamp ballast 94 shown in FIGS. 3A-3C. Each LED driver can be coupled to one or more lamp holders by suitable electrical wiring that facilitates the supply of the electrical power from said LED driver to the LEDs that are plugged into said lamp holder(s). Any combinations of a fluorescent lamp and LED lamp supplied electrical power by a fluorescent lamp ballast and LED driver, respectively, in one or more of lighting fixture 2 and 2' is envisioned.

Figure 5:
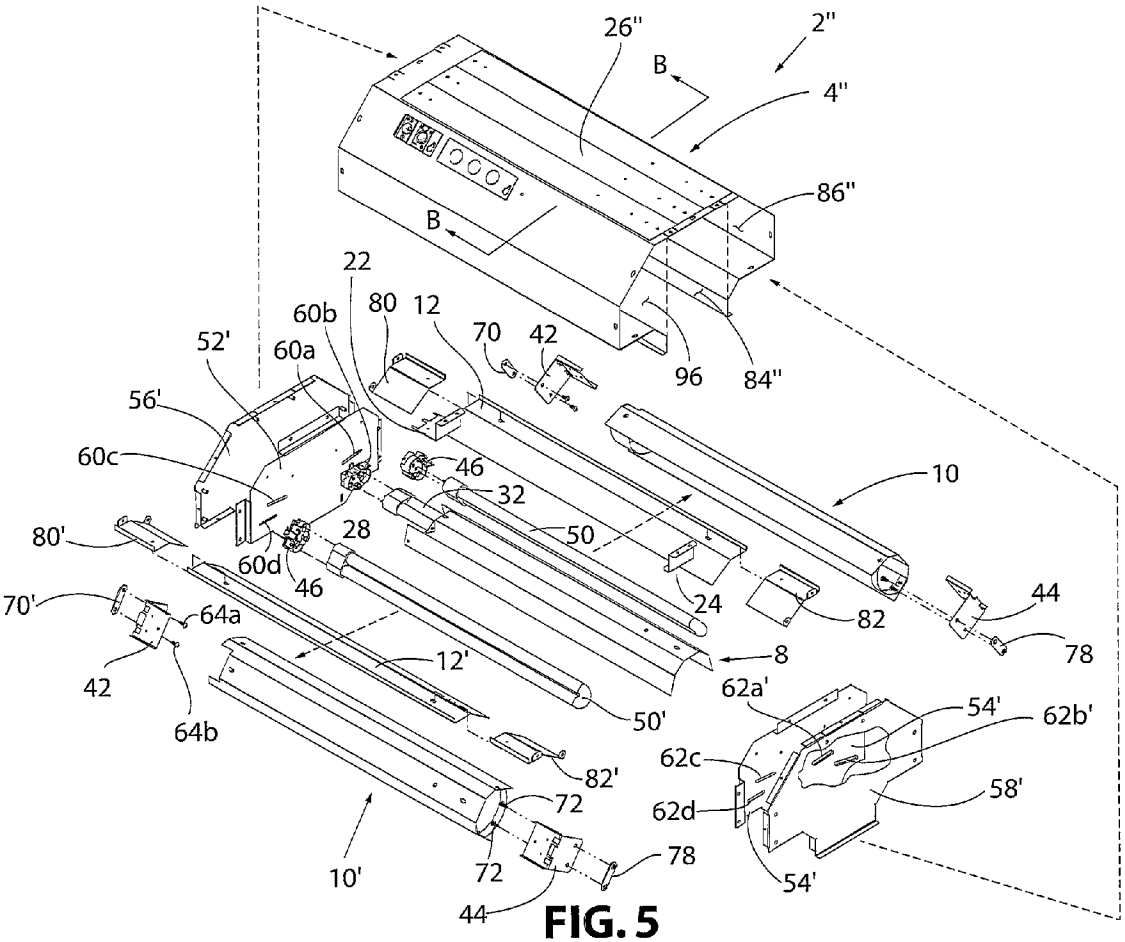
FIG. 5 is an exploded perspective view of a third embodiment lighting fixture including a pair of movable lamp carriage assemblies on opposite sides of a positional fixed lamp carriage assembly.

With reference to FIG. 5 and with continuing reference to all previous figures, another embodiment lighting fixture 2" includes an elongated housing 4" having a top 26". As can be seen, housing 4" defines a first space 84", a second space 86" (corresponding to spaces 84 and 86 of the embodiment of lighting fixture 2 shown in FIGS. 1-3C), and a third space 96 to a side of first space 84" opposite second space 86". First lamp carriage assembly 8 (similar to first lamp carriage assembly 8 in FIG. 1) is configured to be supported by top 26" within first space 84" in a manner similar to the way that first lamp carriage assembly 8 is supported by top 26 of housing 4 in FIGS. 1-3C. Similarly, second lamp carriage assembly 10 (similar to second lamp carriage assembly 10 in FIG. 1) is configured to be slidably and pivotably supported in second space 86" by a first plate 52' and a second plate 54' in the same way that first plate 52 and second plate 54 support second lamp carriage assembly 10 in housing 4 shown in FIGS. 1-3C.

As shown in FIG. 5, however, first plate 52' and second plate 54' have a different shapes than plates 52 and 54 described above and include slots 60*c* and 60*d* (plate 52') and slots 62*c* and 62*d* (plate 54') in addition to slots 60*a*, 60*b*, 62*a*, and 62*b* of plates 52 and 54 of lighting fixture 2 shown in FIG. 1.

In lighting fixture 2" shown in FIG. 5, second lamp carriage assembly 10 is slidably and pivotably coupled to slots 60*a* and 60*b* of first plate 52' and slots 62*a* and 62*b* of second plate 54' via brackets 42 and 44 in the same manner that second lamp carriage assembly 10 of lighting fixture 2 (FIG. 1) is slidably and pivotably coupled to like numbered slots of first and second plates 52 and 54 thereof. In addition, a third lamp carriage assembly 10' is slidably and pivotably coupled to slots 60*c* and 60*d* of first plate 52' and slots 62*c* and 62*d* of second plate 54' via other instances of brackets 42, 44, bolts 64*a*, 64*b*, 72*a*, and 72*b*, and fasteners 68*a*, 68*b*, 76*a* and 76*b* of oval shaped brackets 70 and 78. In this regard, different instances of the same types of brackets, bolts, and fasteners can be utilized to mount second and third lamp carriage assemblies 10 and 10' to plates 52' and 54'.

Third lamp carriage assembly 10' includes a lamp holder 46 at one end thereof that is configured to mate with a mating connector of a lamp 50'. First and second lamp carriage assemblies 10 and 10' can optionally include lamp supports (not shown in FIG. 5) for supporting their respective lamps 50 and 50'.

Figure 6A:
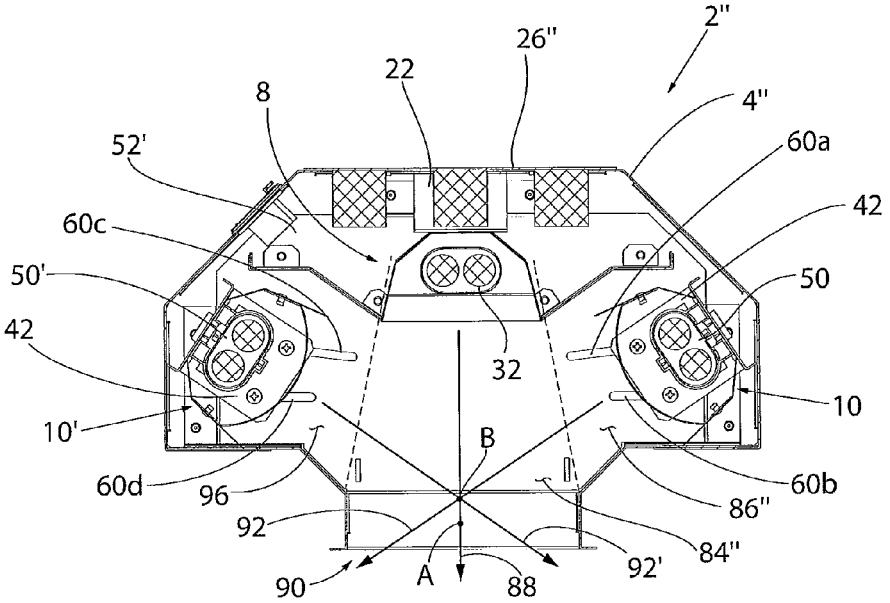
FIG. 6A is a section taken along lines B-B in FIG. 5 with the pair of movable lamp carriage assemblies positioned at one extreme of their movement.
Figure 6B:
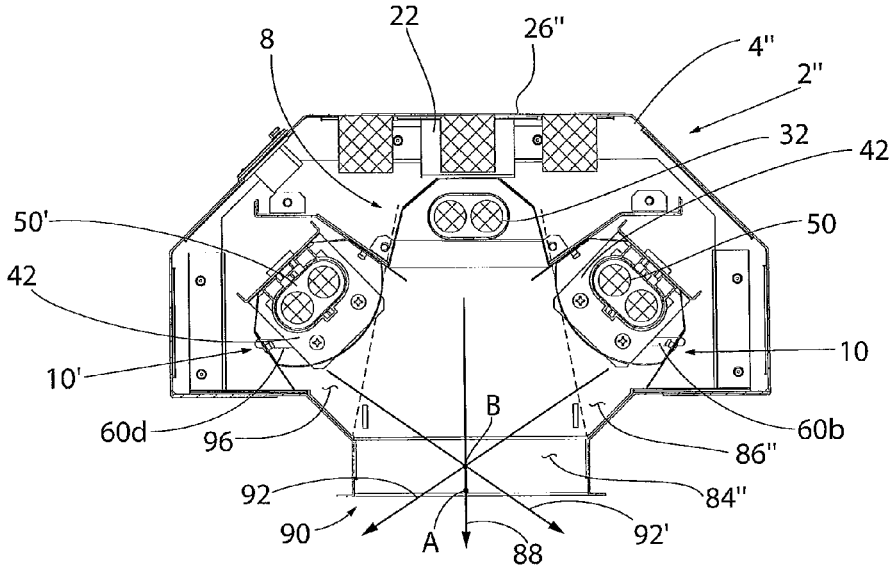
FIG. 6B is the section of FIG. 6A with the pair of movable lamp carriage assemblies positioned at the other extreme of their movement.

FIGS. 6A and 6B are views taken along lines B-B of FIG. 5 after assembly of the components of lighting fixture 2". As can be seen, the longitudinal axes of the first and second lamp carriage assemblies 8 and 10 are positioned at different vertical distances from opening 90. The longitudinal axes of the first and third lamp carriage assemblies 8 and 10' are positioned at different vertical distances from opening 90. Lastly, the longitudinal axes of second and third lamp carriage assemblies 10 and 10' are positioned at the same vertical distance from opening 90. This arrangement enables movement of second and third lamp carriage assemblies 10 and 10' between the extreme positions shown in FIGS. 6A and 6B while avoiding blocking of light output by lamp 32 coupled to first carriage assembly 8.

In FIG. 6A, second and third lamp carriage assemblies 10 and 10' are shown slidably and pivotably moved in their respective second and third spaces 86" and 96 away from first space 84". In response to movement of second and third lamp carriage assemblies 10 and 10' to the extreme positions shown in FIG. 6A, rays of light output by lamps 50 and 50', respectively, are generally directed in the directions shown by arrows 92 and 92' and cross rays of light output by the lamp of first carriage assembly 8 which are generally directed in the direction shown by arrow 88.

Sliding and pivoting second and third lamp carriage assemblies 10 and 10' in second and third spaces 86" and 96 to the positions shown in FIG. 6B adjacent first lamp carriage assembly 8 and first space 84 causes where the rays of light output by second and third lamp carriage assemblies 10 and 10' (shown by arrows 92 and 92') in response to illumination of lamps 50 and 50' cross the light output by first lamp carriage assembly 8 (shown by arrow 88) in response to illumination of lamp 32 to move away from first lamp carriage assembly 8, e.g., from point B toward point A. Conversely, moving second and third lamp carriage assemblies 10 and 10' to the positions shown in FIG. 6A causes where the rays of light output by second and third lamp carriage assemblies 10 and 10' (shown by arrows 92 and 92') in response to illumination of lamps 50 and 50' cross the rays of light output by first lamp carriage assembly 8 (shown by arrow 88) in response to illumination of lamp 32 to move closer to first lamp carriage assembly 8, e.g., from point A toward point B. In other words, in response to sliding and tilting or pivoting second and third lamp assemblies 10 and 10' between the position shown in FIGS. 6A and 6B, the location where the rays of light output by each lamp carriage assembly 10 and 10' cross the rays of light output by first lamp carriage assembly 8 can be adjusted between points A and B, or anywhere therebetween. It is to be appreciated that the positions of second and third lamp carriage assemblies 10 and 10' can be individually adjusted between the extreme end positions shown in FIGS. 6A and 6B or to any position therebetween. For example, second lamp carriage assembly 10 can be in the position shown in FIG. 6A while third lamp carriage assembly 10' can be in the position shown in FIG. 6B, and vice versa.

Figure 7:
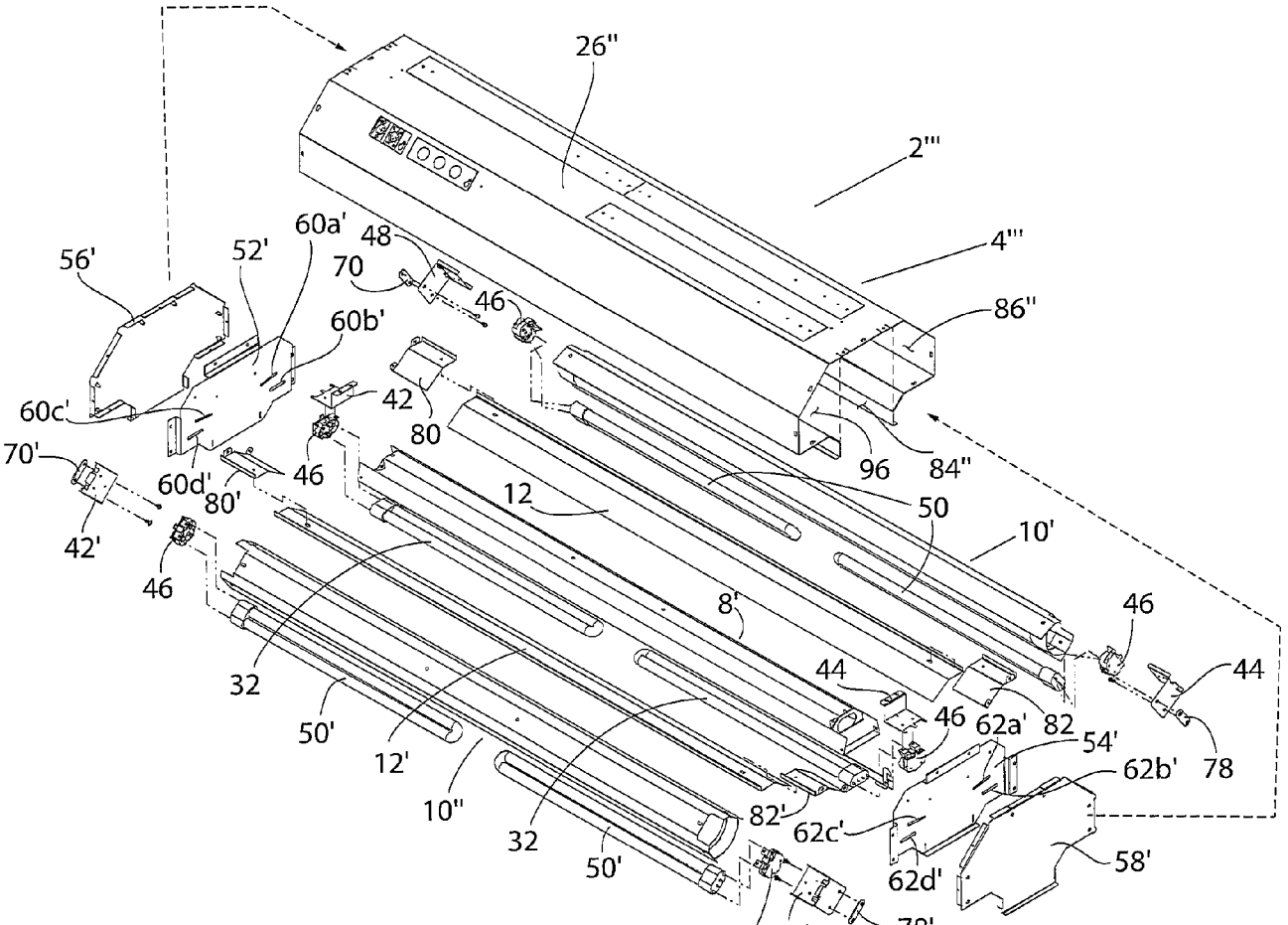
FIG. 7 is an exploded perspective view of a fourth embodiment lighting fixture which is an elongated version of the third embodiment lighting fixture shown in FIG. 5 which is adapted so that each lamp carriage assembly supports a plurality of lamps.

With reference to FIG. 7 and with continuing reference to FIGS. 5-6B, another embodiment light fixture 2" is similar to light fixture 2" shown in FIG. 5 but is elongated. Specifically, the embodiment of lighting fixture 2'" shown in FIG. 7 comprises housing 4'" and first, second, and third lamp carriage assemblies 8', 10', and 10" which are stretched or elongated versions of housing 4" and lamp carriage assemblies 8, 10, and 10' in the embodiment of lighting fixture 2" shown in FIG. 5.

First, second, and third lamp carriage assemblies 8', 10', and 10" in FIG. 7 are each configured or adapted to support plural, e.g., two, lamps. For example, first lamp carriage assembly 8' in FIG. 7 can include at each end thereof a lamp holder 46 which is configured to mate with the mating electrical connector of a lamp 32, in the form of a fluorescent lamp or a plurality of LEDs. The two lamps 32 of first lamp carriage assembly 8' can extend towards each other with their distal ends in spaced relation.

Similarly, second lamp carriage assembly 10' in FIG. 7 can include at each end thereof a lamp holder 46 which is configured to mate with the mating electrical connector of a lamp 50. The two lamps 50 of second lamp carriage assembly 10' can extend toward each other along the length of second lamp carriage assembly 10 with their distal ends in spaced relation.

Lastly, third lamp carriage assembly 10" in FIG. 7 can include at each end thereof a lamp holder 46 which is configured to mate with the mating electrical connector of a lamp 50'. The pair of lamps 50' of third lamp carriage assembly 10" can extend toward each other along the length of third lamp carriage assembly 10" with their distal ends in spaced relation.

Other than increasing the lengths of housing 4" and first, second, and third lamp carriage assemblies 8', 10', and 10", and the addition of additional lamps 32, 50, and 50', the components of lighting fixture 2''' shown in FIG. 7 are similar to and operate in the same manner as like components in the embodiment of lighting fixture 2" shown in FIG. 5. Accordingly, the connection of these components and the sliding and pivoting of second and third lamp carriage assemblies 10' and 10" in FIG. 7 is similar to the sliding and pivoting of second and third lamp carriage assemblies 10 and 10', respectively, in FIG. 5. Accordingly, a detailed description of these components and their operation in the embodiment of lighting fixture 2''' will not be described herein to avoid unnecessary redundancy.

The various embodiment lighting fixtures described above are intended to be installed in drop ceilings which are known in the art as secondary ceilings that are hung below a main (structural ceiling). Drop ceilings are also referred to as a drop ceiling, false ceiling, or suspended ceiling, and are widely utilized.

The above-described embodiment light fixtures can be supported by the grid-work of a drop ceiling in a plenum space defined in the area above the drop ceiling. Also or alternatively, the various embodiment lighting fixtures described above can be installed above a plaster or drywall ceiling in one or more spaces thereabove, typically between the joices that define the support structure of the plaster or drywall ceilings.

A benefit of the above-described embodiment lighting fixtures is the ability to direct light in multiple directions into a room below the ceiling. Because of the compact construction thereof, the various embodiment lighting fixtures described above are able to provide lighting in multiple directions from a compact lighting fixture. Applications for the various embodiment lighting fixtures discussed above include, without limitation, video conferencing, distance learning, telemedicine, internet video streaming, architectural lighting, and the like where light output in multiple directions from a single fixture is desired.

The present invention has been described with reference to a number of embodiments. Obvious modifications and alterations will occur to others upon reading and understanding the preceding detailed description. For example, it is envisioned that each lamp 32, 50, and/or 50' can be a fluorescent lamp, one or more LEDs, or any other suitable and/or desirable lamp that can be electrically driven directly from a power line or electrically driven via a suitable ballast or driver circuit. Accordingly, the lamps described herein are not to be construed in any manner as limiting the invention. It is intended that the invention be construed as including all such alterations and modifications insofar as they come within the scope of the appended claims or the equivalence thereof.

The invention claimed is:

1. A lighting fixture comprising:

an elongated housing defining an elongated opening, an interior of the housing defining a first space aligned with the elongated opening and a second space to a first side of the first space and not aligned with the opening;

first and second lamp carriage assemblies positioned in the respective first and second spaces inside the housing with their longitudinal axes substantially parallel with the elongated opening, the first lamp carriage assembly positioned for directing light output by a lamp supported by the first lamp carriage assembly through the elongated opening in a first direction, the second lamp carriage assembly positioned for directing light output by a lamp supported by the second lamp carriage through the elongated opening in a second direction; and means for adjusting an orientation of the second lamp carriage assembly and, hence, an angle of the second direction that the second lamp carriage directs rays of light output by the lamp thereof.

2. The lighting fixture of claim 1, wherein:

rays of light output by the lamp supported by the first lamp carriage assembly that pass directly through the opening in the first direction pass substantially normal to the opening; and rays of light output by the lamp supported by the second lamp carriage assembly that pass directly through the opening in the second direction pass transverse to the opening.

3. The lighting fixture of claim 1, wherein the longitudinal axes of the first and second lamp carriage assemblies are positioned at different vertical distances from the opening.

4. The lighting fixture of claim 1, wherein the means for adjusting includes at or adjacent each end of the housing:

a pair of spaced slots in a plate; and a bracket slidably and pivotally coupling one end the second lamp carriage assembly to the pair of spaced slots, the pair of spaced slots and bracket adapted to enable the second lamp carriage assembly to slidably and pivotally move in the second space between a location away from the first space and a location toward the first space.

5. The lighting fixture of claim 4, wherein in each slot is slidably received an elongated member that is fixed at one end to the bracket.

6. The lighting fixture of claim 4, wherein the elongated member is a bolt having a head on one side of the slot and male threads on the other side of the slot, which male threads are mated with female threads of a fastener on the other side of the slot.

7. The lighting fixture of claim 1, wherein:

the first lamp carriage assembly includes a first reflector for reflecting the light output by the lamp supported by the first lamp carriage assembly in the first direction; and the second lamp carriage assembly includes a second reflector for reflecting the light output by the lamp supported by the second lamp carriage assembly in the second direction.

8. The lighting fixture of claim 1, wherein:

each lamp carriage assembly includes a lamp; and each lamp comprises:

a fluorescent lamp; or one or more light emitting diodes (LEDs).

9. The lighting fixture of claim 1, further including at least one of the following:

a fluorescent lamp ballast operative for controlling electrical power to the lamp, in the nature of a fluorescent lamp, of at least one lamp carriage assembly; or an LED driver (or ballast) operative for controlling electrical power to the lamp, in the nature of one or more LEDs, of at least one lamp carriage assembly.

10. The lighting fixture of claim 1, further including:

the interior of the housing including a third space to a second side of the first space opposite the second space;

a third lamp carriage assembly positioned in the third space inside the housing with its longitudinal axis substantially parallel with the elongated opening, the third lamp carriage assembly positioned for directing light output by a lamp of the third lamp carriage through the elongated opening in a third direction.

11. The lighting fixture of claim 10, wherein:

rays of light output by the lamp of the first lamp carriage assembly that pass directly from the lamp through the opening in the first direction pass substantially normal to the opening;

rays of light output by the lamp of the second lamp carriage assembly that pass directly from the lamp through the opening in the second direction pass transverse to the opening; and rays of light output by the lamp of the third lamp carriage assembly that pass directly from the lamp through the opening in the third direction pass transverse to the opening.

12. The lighting fixture of claim 10, wherein:

the longitudinal axes of the first and second lamp carriage assemblies are positioned at different vertical distances from the opening;

the longitudinal axes of the first and third lamp carriage assemblies are positioned at different vertical distances from the opening; and the longitudinal axes of the second and third lamp carriage assemblies are positioned at the same vertical distance from the opening.

13. The lighting fixture of claim 10, further including:

means for adjusting an orientation of the second lamp carriage assembly and, hence, an angle of the second direction that the second lamp carriage directs rays of light output by the lamp thereof; and means for adjusting an orientation of the third lamp carriage assembly and, hence, an angle of the third direction that the third lamp carriage directs rays of light output by the lamp thereof.

14. A lighting fixture comprising:

first and second elongated lamp carriage assemblies operative for supporting respective first and second elongated lamps; and an enclosure including first and second spaced plates, the first lamp carriage assembly fixedly coupled between the first and second plates for directing light output by the first lamp in a first direction, the second lamp carriage assembly slidably and pivotally coupled at its ends to the first and second plates for directing light output by the second lamp in a second direction that crosses the first direction;

wherein a pair of spaced slots in each plate are configured such that the second lamp carriage assembly pivots during sliding of the second lamp carriage assembly toward the first lamp carriage assembly or during sliding of the second lamp carriage away from the first lamp carriage assembly, whereupon:

when the second lamp carriage assembly slides toward the first lamp carriage assembly the second lamp carriage assembly pivots such that where the second direction of the light output by the second lamp crosses the first direction of the light output by the first lamp moves away from the first lamp carriage assembly; and when the second lamp carriage assembly slides away the first lamp carriage assembly the second lamp carriage assembly pivots such that where the second direction of the light output by the second lamp crosses the first direction of the light output by the first lamp moves toward the first lamp carriage assembly.

15. The lighting fixture of claim 14, wherein the first lamp carriage assembly is coupled to a top of the enclosure.

16. The lighting fixture of claim 14, wherein each plate includes the pair of spaced slots and each end of the second lamp carriage assembly includes a pair of spaced elongated members that extend through the pair of spaced slots in the plate to which the end is slidably and pivotally coupled, wherein responsive to slidable movement of the elongated members in the slots the second lamp carriage assembly slides and pivots.

17. The lighting fixture of claim 14, wherein:

the first direction is substantially normal to an opening in a housing of the lighting fixture; and the second direction is transverse to the opening in the housing.

18. The lighting fixture of claim 14, further including:

a third elongated lamp carriage assembly supporting a third elongated lamp;

the third lamp carriage assembly slidably and pivotally coupled at its ends to the first and second plates for directing light output by the third lamp in a third direction that crosses the first and second directions.

19. The lighting fixture of claim 14, further including each lamp carriage assembly including a lamp.

* * * * *